US010209002B2

(12) United States Patent
Hwang et al.

(10) Patent No.: US 10,209,002 B2
(45) Date of Patent: Feb. 19, 2019

(54) RAIL DEVICE AND REFRIGERATOR HAVING THE SAME

(71) Applicant: SAMSUNG ELECTRONICS CO., LTD., Suwon-si, Gyeonggi-do (KR)

(72) Inventors: Jin-Ha Hwang, Suwon-si (KR); Mu-Yeol Sun, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/451,666

(22) Filed: Mar. 7, 2017

(65) Prior Publication Data

US 2017/0254586 A1 Sep. 7, 2017

(30) Foreign Application Priority Data

Mar. 7, 2016 (KR) ..... 10-2016-0027232

(51) Int. Cl.

| | |
|---|---|
| ***A47B 88/00*** | (2017.01) |
| ***F25D 25/02*** | (2006.01) |
| ***A47B 88/473*** | (2017.01) |
| ***A47B 88/49*** | (2017.01) |
| ***A47B 88/493*** | (2017.01) |
| ***A47B 88/483*** | (2017.01) |

(52) U.S. Cl.

CPC ..... *F25D 25/025* (2013.01); *A47B 88/473* (2017.01); *A47B 88/483* (2017.01); *A47B 88/49* (2017.01); *A47B 88/493* (2017.01)

(58) Field of Classification Search

CPC ..... A47B 88/40; A47B 88/44; A47B 88/443; A47B 88/447; A47B 88/45; A47B 88/473; A47B 88/477

USPC ..... 312/333, 334.44, 334.46

See application file for complete search history.

(56) References Cited

U.S. PATENT DOCUMENTS 3,904,254 A * 9/1975 Hagen ..... F16C 29/04 312/334.47

4,469,384 A * 9/1984 Fler ..... A47B 88/493 312/333

(Continued)

FOREIGN PATENT DOCUMENTS

| | | |
|---|---|---|
| JP | 3180645 | 12/2012 |
| KR | 1998-052379 | 9/1998 |

(Continued)

*Primary Examiner* — Matthew W Ing

(74) *Attorney, Agent, or Firm* — Staas & Halsey LLP

(57) ABSTRACT

Disclosed herein is a refrigerator. The refrigerator includes a body having a storage compartment therein, a storage body provided to be inserted into or withdrawn from the storage compartment, and a rail device configured to connect the body and the storage body slidingly and to guide insertion and withdrawal of the storage body, wherein the rail device includes a first rail member having a first guider therein, a second rail member slidingly coupled to the first rail member, and a first retainer disposed at an insertion position between the first rail member and the second rail member when the first rail member is inserted into the first retainer and having a first guide protrusion inserted into the first guider movably, formed in the first retainer, and the first guider limits a range of movement in an insertion direction of the first retainer when the first retainer is inserted into the first guider so that the first retainer is located at the insertion position.

19 Claims, 17 Drawing Sheets

(56) References Cited

U.S. PATENT DOCUMENTS

| | | | | | |
|---|---|---|---|---|---|
| 4,988,214 | A * | 1/1991 | Clement | A47B 88/493 312/333 |
| 5,262,923 | A * | 11/1993 | Batta | G06F 1/184 312/333 |
| 6,145,945 | A * | 11/2000 | Parvin | A47B 88/493 312/334.11 |
| 6,764,151 | B2 * | 7/2004 | Huang | A47B 88/487 312/334.44 |
| 7,357,468 | B2 * | 4/2008 | Hwang | A47B 88/49 312/333 |
| 7,731,312 | B2 * | 6/2010 | Chen | A47B 88/57 312/333 |
| 8,147,011 | B2 * | 4/2012 | Chen | H05K 7/1489 312/333 |
| 2003/0209959 | A1 * | 11/2003 | Shih-Long | A47B 88/49 312/334.46 |
| 2004/0119388 | A1 | 6/2004 | Huang | |
| 2013/0293080 | A1 * | 11/2013 | Kim | F25D 23/02 312/404 |

FOREIGN PATENT DOCUMENTS

| | | |
|---|---|---|
| KR | 1998-065952 | 10/1998 |
| KR | 1998-081405 | 11/1998 |
| KR | 1999-0078163 | 10/1999 |
| KR | 2000-0022909 | 4/2000 |
| KR | 2000-0065215 | 11/2000 |
| KR | 2001-0021176 | 3/2001 |
| KR | 2001-0040246 | 5/2001 |
| KR | 2002-0065964 | 8/2002 |
| KR | 20-0300934 | 1/2003 |
| KR | 2003-0090671 | 11/2003 |
| KR | 10-2005-0024026 | 3/2005 |
| KR | 10-2005-0028206 | 3/2005 |
| KR | 10-2005-0032530 | 4/2005 |
| KR | 10-2005-0087364 | 8/2005 |
| KR | 10-2005-0106962 | 11/2005 |
| KR | 10-2006-0011834 | 2/2006 |
| KR | 10-2006-0014068 | 2/2006 |
| KR | 10-0550375 | 2/2006 |
| KR | 10-2006-0019764 | 3/2006 |
| KR | 10-2006-0117193 | 11/2006 |
| KR | 10-2007-0012679 | 1/2007 |
| KR | 10-0672486 | 1/2007 |
| KR | 10-2007-0041716 | 4/2007 |
| KR | 10-0710723 | 4/2007 |
| KR | 10-2007-0115030 | 12/2007 |
| KR | 10-2007-0119001 | 12/2007 |
| KR | 10-2008-0005769 | 1/2008 |
| KR | 10-2008-0010754 | 1/2008 |
| KR | 10-2008-0010755 | 1/2008 |
| KR | 10-2008-0017565 | 2/2008 |
| KR | 10-2008-0036033 | 4/2008 |
| KR | 10-0874468 | 12/2008 |
| KR | 10-0874469 | 12/2008 |
| KR | 10-2009-0085820 | 8/2009 |
| KR | 10-2009-0122843 | 12/2009 |
| KR | 10-2010-0030362 | 3/2010 |
| KR | 10-2010-0096988 | 9/2010 |
| KR | 10-0990328 | 10/2010 |
| KR | 10-2011-0031340 | 3/2011 |
| KR | 10-2011-0087524 | 8/2011 |
| KR | 10-2011-0090728 | 8/2011 |
| KR | 10-2011-0090729 | 8/2011 |
| KR | 10-1056530 | 8/2011 |
| KR | 10-2012-0128080 | 11/2012 |
| KR | 10-1220463 | 1/2013 |
| KR | 10-1391997 | 4/2013 |
| KR | 10-2013-0091355 | 8/2013 |
| KR | 10-2013-0106515 | 9/2013 |
| KR | 10-2013-0108458 | 10/2013 |
| KR | 10-1334352 | 11/2013 |
| KR | 10-2013-0137282 | 12/2013 |
| KR | 10-1464738 | 11/2014 |
| KR | 10-2015-0051701 | 5/2015 |

* cited by examiner

RAIL DEVICE AND REFRIGERATOR HAVING THE SAME

CROSS-REFERENCE TO RELATED APPLICATION

This application claims the benefit of Korean Patent Application No. 10-2016-0027232, filed on Mar. 7, 2016 in the Korean Intellectual Property Office, the disclosure of which is incorporated herein by reference.

BACKGROUND

1. Field

Embodiments of the present invention relate to a refrigerator and more particularly, to a refrigerator that withdraws and inserts a storage body.

2. Description of the Related Art

A refrigerator is an apparatus that keeps food fresh by including a body having a storage compartment therein and a cold air supplying system for supplying cold air to the storage compartment. The storage compartment includes a refrigerating compartment which is maintained at about 0° C. to 5° C. and in which food is kept under refrigeration, and a freezer compartment which is maintained at about 0° C. to −30° C. and in which food is kept in a freezer.

A storage body for classifying and storing various types of food may be disposed in the storage compartment. The storage body may be inserted into the storage compartment or withdrawn from the storage compartment in various ways such as a rail device, a rack & pinion structure, and the like.

The rail device is installed between a wall surface inside the storage compartment and both side surfaces of the storage body so that the storage body can be in rolling contact with the storage compartment and moved slidingly. The rail device includes a plurality of rail members and a retainer that supports sliding movement between the plurality of rail members.

In the conventional rail device, as a ball is slipped while the storage body is repeatedly inserted into the storage compartment or withdrawn from the storage compartment, a relative position of the retainer with respect to the rail members has been changed. The change of the relative position of the retainer causes the storage body not to be fully withdrawn from the storage compartment.

SUMMARY

Therefore, it is an aspect of the present invention to provide a rail device capable of correcting a relative position of a retainer with respect to rail members.

It is another aspect of the present invention to provide a rail device capable of preventing a storage body from being not fully withdrawn from a storage compartment as a relative position of a retainer with respect to rail members is changed.

It is another aspect of the present invention to provide a rail device capable of preventing the use of an excessive force in withdrawing a storage body from a storage compartment as a relative position of a retainer with respect to rail members is changed.

It is another aspect of the present invention to provide a refrigerator that easily withdraws a storage article inside a storage body from a storage compartment.

Additional aspects of the invention will be set forth in part in the description which follows and, in part, will be obvious from the description, or may be learned by practice of the invention.

In accordance with one aspect of the present disclosure, a refrigerator includes a body having a storage compartment therein, a storage body provided to be inserted into or withdrawn from the storage compartment, and a rail device configured to connect the body and the storage body slidingly and to guide insertion and withdrawal of the storage body, wherein the rail device includes a first rail member having a first guider therein, a second rail member slidingly coupled to the first rail member, and a first retainer disposed at an insertion position between the first rail member and the second rail member when the first rail member is inserted into the first retainer and having a first guide protrusion inserted into the first guider movably, formed in the first retainer, and the first guider limits a range of movement in an insertion direction of the first retainer when the first retainer is inserted into the first guider so that the first retainer is located at the insertion position.

The first retainer may include a second guide protrusion that protrudes to the second rail member, and the second rail member may include a second guider that guides the second guide protrusion.

The second guider may press the second guide protrusion in an insertion direction when the first retainer is inserted into the second guider so that the first retainer is located at the insertion position.

The first guide protrusion may be formed at one side of the first retainer, and the second guide protrusion may be formed at the other side opposite to the one side of the first retainer at which the first guide protrusion is formed.

The first guide protrusion and the second guide protrusion may be formed at one side of the first retainer.

The first rail member may include a first support protrusion that supports the second rail member so that, when the second rail member is inserted into the first rail member, the second rail member does not escape from the first rail member.

The first rail member may include a second support protrusion that supports the first retainer so that, when the first retainer is withdrawn from the first rail member, the first retainer does not escape from the first rail member, and the second rail member may include a third support protrusion supported by the first retainer so that, when the second rail member is withdrawn from the first rail member, the second rail member does not escape from the first rail member.

At least one of the first guide protrusion and the second guide protrusion may have elasticity.

The refrigerator may further include a third rail member slidingly coupled to the second rail member, and a second retainer that supports sliding movement of the third rail member.

A plurality of first guiders and a plurality of first guide protrusions may be provided.

In accordance with another aspect of the present disclosure, a refrigerator include a body having a storage compartment therein, a storage body provided to be inserted into or withdrawn from the storage compartment, and a rail device configured to connect the body and the storage body slidingly and to guide insertion and withdrawal of the storage body, wherein the rail device includes, a first rail member fixed to the body and having a first guider therein, a second rail member slidingly coupled to the first rail member and having a second guider therein, and a first retainer supporting sliding movement of the second rail member and having a first guide protrusion guided by the first guider and a second guide protrusion guided by the second guider.

When the storage body is inserted into the body, the first retainer may be located at an insertion position by means of the first guider or the second guider.

The rail device may further include a third rail member fixed to the storage body and slidingly coupled to the second rail member, and a second retainer supporting sliding movement of the third rail member.

The second guide protrusion may protrude in an opposite direction to a direction in which the first guide protrusion protrudes.

The first rail member may include a first support protrusion that supports the second rail member so that, when the second rail member is inserted into the first rail member, the second rail member does not escape from the first rail member.

In accordance with still another aspect of the present disclosure, a rail device includes a first rail member, a second rail member slidingly coupled to the first rail member, a first retainer supporting sliding movement of the second rail member and disposed at an insertion position when the second rail member is inserted into the first rail member, and a position correction guide that guides the first retainer so that, when the second rail member is inserted into the first rail member, the first retainer is located at the insertion position.

The position correction guide may include a first guider formed on the first rail member, and a first guide protrusion formed on the first retainer and guided by the first guider.

The position correction guide may include a second guider formed on the second rail member, and a second guide protrusion formed on the first retainer and guided by the second guider.

When the first retainer is inserted into the first rail member, the first guide protrusion may be in contact with one end of an insertion direction of the first guider, and the second guide protrusion may be in contact with one end of a withdrawal direction of the second guider.

The position correction guide may include a limiting protrusion that protrudes on a sliding movement path of the second rail member formed on the first rail member.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
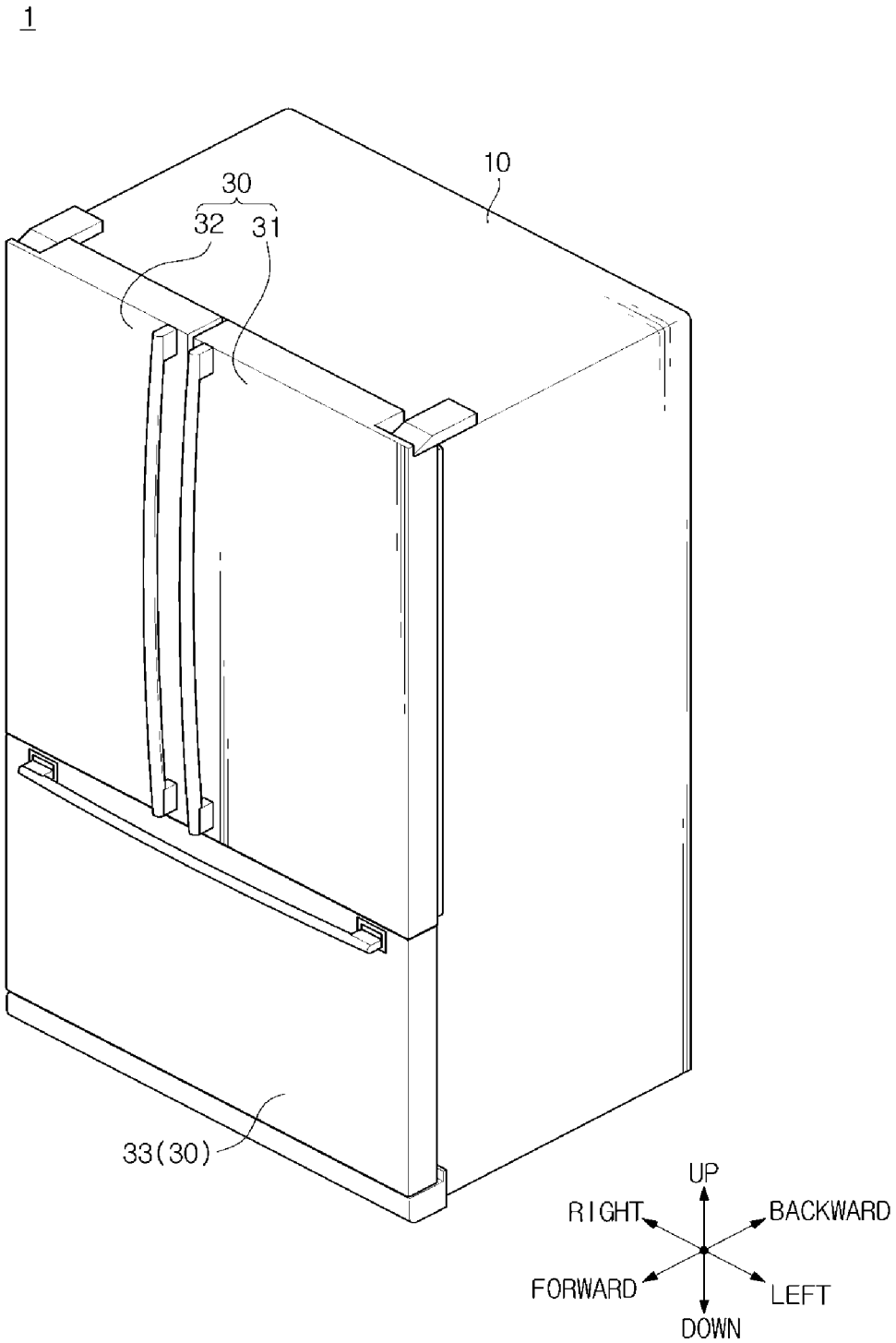
FIG. 1 is a view illustrating an exterior of a refrigerator according to an embodiment of the present invention.

Embodiments described in the present specification and configuration shown in the drawings are just exemplary embodiments of the invention, and there may be various modifications that may replace the embodiments of the present specification and the drawings at the time of filing the present application.

Like reference numerals or symbols in each of the drawings of the present specification represent components or elements that perform substantially the same functions.

The terms used in the present specification are merely used to describe particular embodiments, and are not intended to limit the present invention. An expression used in the singular encompasses the expression of the plural, unless it has a clearly different meaning in the context. In the present specification, it is to be understood that the terms such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

It will be understood that although the terms first and second are used herein to describe various elements, these elements should not be limited by these terms. These terms are only used to distinguish one element from another element. Thus, a first element discussed below could be termed a second element, and similarly, a second element may be termed a first element without departing from the teachings of this disclosure. As used herein, the term "and/or" includes any and all combinations of one or more of the associated listed items.

The terms used herein, such as a "front end", a "rear end", an "upper portion", a "lower portion", a "top end", and a "bottom end", are defined based on the drawings, and the shape and position of each element are not limited by the terms.

Hereinafter, embodiments of the present invention will be described in detail with reference to the attached drawings.

Figure 2:
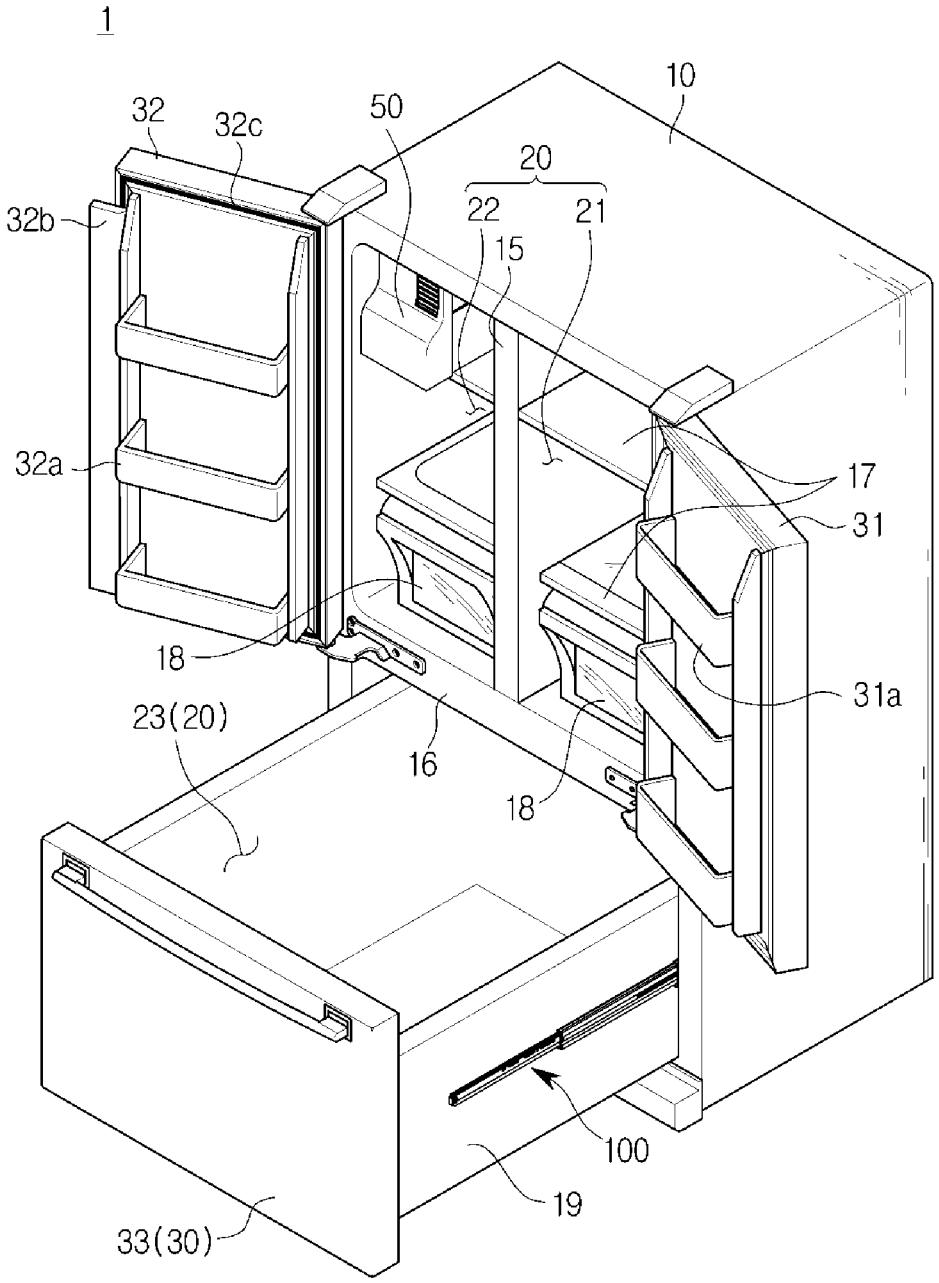
FIG. 2 is a view illustrating an example in which a door of the refrigerator illustrated in FIG. 1 is open.

FIG. 1 is a view illustrating an exterior of a refrigerator according to an embodiment of the present invention. FIG. 2 is a view illustrating an example in which a door of the refrigerator illustrated in FIG. 1 is open.

Referring to FIGS. 1 and 2, a refrigerator 1 may include a body 10 that constitutes the exterior of the refrigerator 1, and a door 30 provided at one side of the body 10.

The body 10 may be provided in such a way that a front surface of the body 10 is open and other surfaces excluding the front surface thereof are closed. A storage compartment 20 and various components required for cooling of the storage compartment 20 may be installed in the body 10.

The door 30 may be installed to open/close the front surface of the body 10, and the storage compartment 20 provided in the body 10 may be exposed to the outside according to an opening/closing operation of the door 30. According to an embodiment, the door 30 may include a first door 31 and a second door 32, which are coupled to each other to be pivotable by means of a hinge disposed at one side of the front surface of the body 10 and installed to open/close the storage compartment 20. Also, the door 30 may include a third door 33 that is installed at the body 10 and can be withdrawn in the form of a drawer from the inside of the body 10 to the outside by means of a rail device 100 installed in the body 10.

Each of the plurality of doors 31 to 33 may be independently open/closed. When each of the first to third doors 31 to 33 is open, first to third storage compartments 21 to 23 that correspond to the first to third doors 31 to 33 may be exposed to the outside. For example, when the first door 31 is rotated around a hinge axis, the first storage compartment 21 disposed at a position corresponding to the first door 31 may be exposed to the outside. When each of the first to third doors 31 to 33 is open, a user may accept and store food in each of the first to third storage compartments 21 to 23 through the open front surface of the body 10.

A dispenser (not shown) may be installed at a part of the door 30 so as to provide water, carbonated water, or ice. The dispenser (not shown) may provide water purified by a purifying device to the user or may provide ice generated by an ice making device 50 to the user.

Door guards 31*a* and 32*a* may be disposed at rear surfaces of the first door 31 and the second door 32 so as to store various types of food. A gasket 32*c* may be disposed at edges of the rear surfaces of the first door 31 and the second door 32 so as to seal between the first door 31 and the body 10 and between the second door 32 and the body 10, respectively, when the first door 31 and the second door 32 are closed, thereby preventing cold air in the first storage compartment 21 and the second storage compartment 22 from being discharged. Also, a rotation bar 32*b* may be installed at the second door 32 so as to seal between the first door 31 and the second door 32 when the first door 31 and the second door 32 are closed, thereby preventing cold air in the first storage compartment 21 and the second storage compartment 22 from being discharged to the outside.

The body 10 may include frames 15 and 16 that partition an internal space of the body 10, and each of the first to third storage compartments 21 to 23 may be formed by each of the frames 15 and 16 and the body 10. The frames 15 and 16 may be formed of a material in which heat transfer is not easily performed, thereby preventing cold air in one of the first to third storage compartments 21 to 23 from being transferred to another one of the first to third storage compartments 21 to 23.

Each of the storage compartments 21 to 23 is disposed to keep food stored therein at a predetermined temperature or less. In this case, each of the first to third storage compartments 21 to 23 may be a refrigerating compartment, a temperature-changing compartment, or a freezer compartment according to a setting temperature.

Various types of shelves 17 in which food can be kept, may be disposed in the first storage compartment 21 and the second storage compartment 22. Also, a first storage body 18 in which food such as vegetables or fruits can be kept, may be disposed in the first storage compartment 21 and the second storage compartment 22. The first storage body 18 may be inserted into the first storage compartment 21 and the second storage compartment 22 or withdrawn from the inside of the first storage compartment 21 and the second storage compartment 22 by means of the rail device 100 that will be described later.

A second storage body 19 that constitutes the third storage compartment 23 may be disposed at a rear surface of the third door 33. The second storage body 19 may include an additional storage box (not shown) provided therein. The second storage body 19 may be inserted into the third storage compartment 23 or withdrawn from the inside of the third storage compartment 23 by means of the rail device 100.

Figure 3:
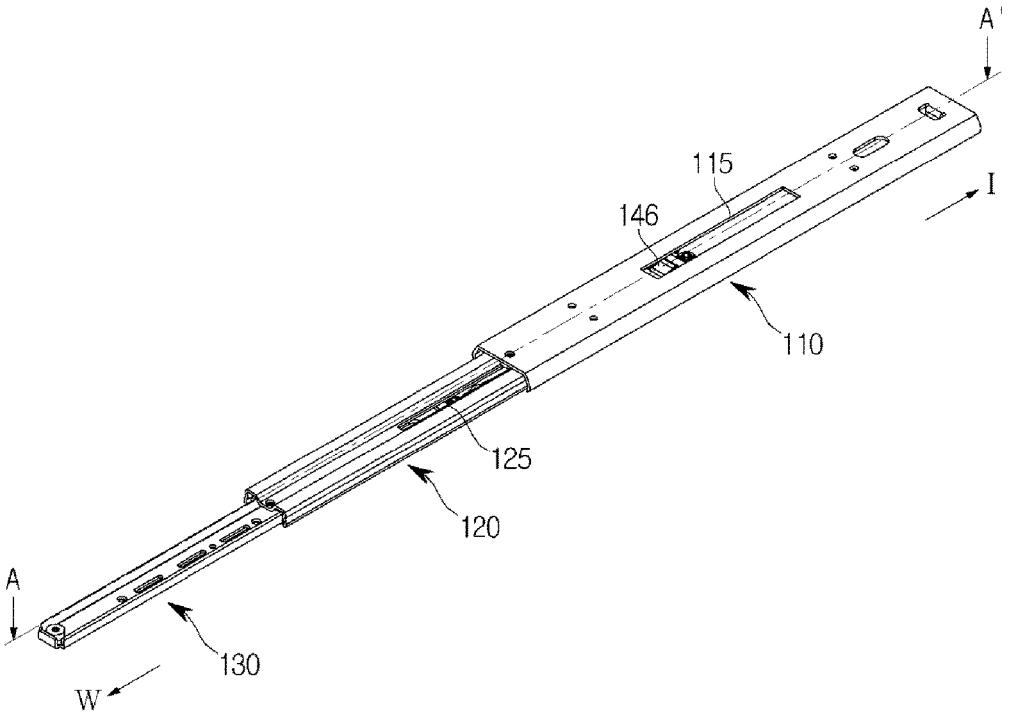
FIG. 3 is a perspective view of a rail device illustrated in FIG. 2.
Figure 4:
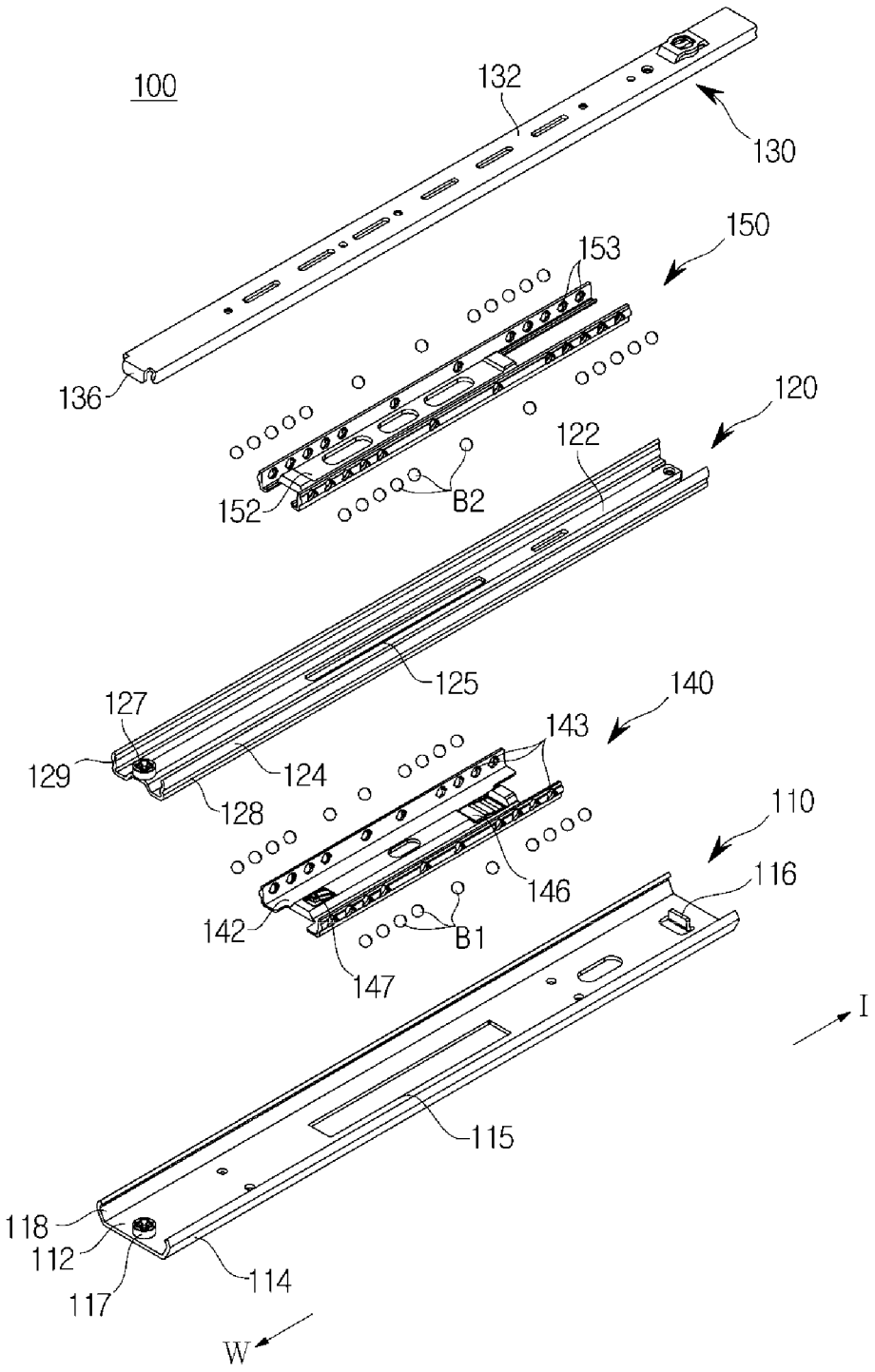
FIG. 4 is an exploded perspective view of the rail device illustrated in FIG. 3.

FIG. 3 is a perspective view of a rail device illustrated in FIG. 2. FIG. 4 is an exploded perspective view of the rail device illustrated in FIG. 3.

Hereinafter, the rail device 100 will be described with reference to FIGS. 3 and 4. The rail device 100 according to an embodiment of the present invention may be used for the above-described operation of inserting and withdrawing the first storage body 18 and/or the second storage body 19. However, embodiments of the present invention are not limited thereto, and the rail device 100 may be used in any place where sliding driving is required, like in a desk and a drawer.

The rail device 100 may include a first rail member 110 fixed to the inside of the storage compartment 20 of the body 10, a second rail member 120 slidingly coupled to the first rail member 110, a first retainer 140 that supports sliding movement of the second rail member 120, a third rail member 130 slidingly coupled to the second rail member 120 and fixed to the storage bodies 18 and 19, and a second retainer 150 that supports sliding movement of the third rail member 130.

The first rail member 110 is fixed to an inner wall surface of the body 10 of the refrigerator 1 and supports the storage bodies 18 and 19 to slide. The first rail member 110 may include a first rail member body 112, and a first rail member flange 114 bent at both sides of the first rail member body 112.

A first support protrusion 116 may be provided at one side of an insertion direction I of the first rail member body 112 so as to support the second rail member 120 to prevent escape of the second rail member 120 in the insertion direction I of the second rail member 120. The first support protrusion 116 may be formed by bending a part of the first rail member body 112 in a direction in which the second rail member 120 is coupled to the first rail member 110. Thus, the second rail member 120 may be prevented from escaping from the first rail member 110 in the insertion direction I.

A second support protrusion 117 may be formed at one side of a withdrawal direction W of the first rail member body 112 so as to support the first retainer 140 to prevent escape of the first retainer 140 in the withdrawal direction W of the first retainer 140. When the first retainer 140 is at a withdrawal position, the second support protrusion 117 may be in contact with one end of the withdrawal direction W of the first retainer 140 and may support the first retainer 140.

The first rail member body 112 may include a first guider 115 into which a first guide protrusion 146 of the first retainer 140 is inserted and which guides the first guide protrusion 146. The first guider 115 may be formed along a movement path of approximately the first guide protrusion 146. One side surface of the insertion direction I of the first guider 115 may be in contact with the first guide protrusion 146 and may limit movement in the insertion direction I of the first guide protrusion 146.

A first rail raceway 118 on which a first ball B1 of the first retainer 140 is supported, may be disposed at an inner circumferential surface of the first rail member flange 114. Thus, the first ball B1 of the first retainer 140 may slide while being in rolling contact with the first rail member 110 along the first rail raceway 118. The first rail raceway 118 may be formed in a longitudinal direction of the first rail member 110 so as to accommodate the first ball B1.

The second rail member 120 may be slidingly coupled to the first rail member 110. The second rail member 120 may be coupled to an inside of the first rail member flange 114 of the first rail member 110. The second rail member 120 may include a second rail member body 122, and a second rail member flange 124 bent at both sides of the second rail member body 122.

A third support protrusion 126 may be formed at one side of the insertion direction I of the second rail member body 122 and supported by the first support protrusion 116. When the second rail member 120 is inserted into the first rail member 110, the third support protrusion 126 is supported by the first support protrusion 116, and when the second rail member 120 is withdrawn from the first rail member 110, the third support protrusion 126 is supported by one end of the insertion direction I of the first retainer 140. That is, due to the third support protrusion 126, the second rail member 120 may be prevented from escaping from the first rail member 110.

A fourth support protrusion 127 may be formed at one side of the withdrawal direction W of the second rail member body 122 to support the second retainer 150 to prevent escape of the second retainer 150 in the withdrawal direction W. When the second retainer 150 is at a withdrawal position, the fourth support protrusion 127 may support the second retainer 150 while being in contact with one end of the withdrawal direction W of the second retainer 150. Furthermore, the fourth support protrusion 127 may support a fifth support protrusion 156 that will be described later, to prevent escape of the third rail member 130 in the insertion direction I in a state in which the rail device 100 is inserted into the storage compartment.

The second rail member body 122 may include a second guider 125 into which a second guide protrusion 147 of the first retainer 140 is inserted and which guides the second guide protrusion 147. The second guider 125 may be formed along a movement path of approximately the second guide protrusion 147. One side surface of the withdrawal direction W of the second guider 125 may be in contact with the second guide protrusion 147, may press the second guide protrusion 147 and may move the first retainer 140 in the insertion direction I.

The second rail member flange 124 may include an outer raceway 128 on which the first ball B1 of the first retainer 140 is supported, and an inner raceway 129 on which a ball B2 of the second retainer 150 that will be described later is supported. The outer raceway 128 may be formed at an outer side surface of the second rail member flange 124, and the inner raceway 129 may be formed at an inner side surface of the second rail member flange 124. The outer raceway 128 and the inner raceway 129 may be formed in a longitudinal direction.

The first retainer 140 may be disposed between the first rail member 110 and the second rail member 120 and may support sliding movement of the second rail member 120. The first retainer 140 may include a plurality of first balls B1, and a first retainer body 142 that supports the plurality of first balls B1 rotatably.

The first retainer body 142 may include a first ball groove 143 into which the first ball B1 is rotatably inserted. Thus, the first ball B1 may rotate along the first rail raceway 118 and the outer raceway 128 while being inserted into the first ball groove 143.

The first retainer body 142 may include the first guide protrusion 146 inserted into the first guider 115 and guided by the first guider 115, and the second guide protrusion 147 inserted into the second guider 125 and guided by the second guider 125.

The first guide protrusion 146 may be formed by bending a part of the first retainer body 142 toward the first rail member 110. However, embodiments of the present invention are not limited thereto, and the first guide protrusion 146 may also be provided by coupling an additional member to the first retainer body 142. The first guide protrusion 146 may be provided at one side of the insertion direction I of the first retainer body 142.

The first guide protrusion 146 may be inclined toward the first rail member 110 as getting closer to the insertion direction I from the first retainer body 142 and may have predetermined elasticity. That is, the first guide protrusion 146 may be elastically deformed toward the first retainer body 142 not to limit movement of the first retainer 140 when the first retainer 140 inside the first rail member 110 moves in the withdrawal direction W. Thus, when the first retainer 140 is assembled to the first rail member 110, the first retainer 140 may be inserted into the first rail member 110 from one end of the insertion direction I of the first rail member 110 and may slide in the withdrawal direction W and thus may be easily assembled to the first rail member 110.

The second guide protrusion 147 may be formed by bending a part of the first retainer body 142 toward the second rail member 120. However, embodiments of the present invention are not limited thereto, and the second guide protrusion 147 may also be provided by coupling an additional member to the first retainer body 142. The second guide protrusion 147 may be provided at one side of the withdrawal direction W of the first retainer body 142.

The second guide protrusion 147 may be inclined toward the second rail member 120 as getting closer to the withdrawal direction W from the first retainer body 142 and may have predetermined elasticity. That is, the second guide protrusion 147 may be elastically deformed toward the first retainer body 142 not to limit movement of the second rail member 120 when the second rail member 120 inside the first rail member 110 moves in the withdrawal direction W. Thus, when the first retainer 140 is assembled to the first rail member 110 and simultaneously the second rail member 120 is assembled to the inside of the first retainer 140, the second rail member 120 may be inserted into the first retainer 140 from one end of the insertion direction I of the first retainer 140 and may slide in the withdrawal direction W and thus may be easily assembled to the first retainer 140.

Due to the above-described first guide protrusion 146 and second guide protrusion 147, the first retainer 140 may be disposed at its original position whenever the storage bodies 18 and 19 are inserted into the storage compartment 20. A member that corrects the position of the first retainer 140 including the first guide protrusion 146, the second guide protrusion 147, the first guider 115 and the second guider 125 will be referred to as a position correction guide 160.

The third rail member 130 may be installed at both sides of the storage bodies 18 and 19, and when the storage bodies 18 and 19 are inserted into the body 10 or withdrawn from the body 10, the third rail member 130 slides together with the storage bodies 18 and 19. The third rail member 130 may include a third rail member body 132, and a third rail member flange 134 bent at the third rail member body 132.

The third rail member body 132 may include a fifth support protrusion 136 bent at one end of the withdrawal direction W. The fifth support protrusion 136 may be supported by the fourth support protrusion 127 to prevent the third rail member 130 from escaping in the insertion direction I.

The third rail member body 132 may include a sixth support protrusion 137 that protrudes from one end of the insertion direction I to prevent the third rail member 130 from escaping in the withdrawal direction W. The sixth support protrusion 137 is in contact with one end of the insertion direction I of the second retainer 150 and is supported by the second retainer 150 when the third rail member 130 is at a withdrawal position.

A third rail raceway 138 that guides a second ball B2 of the second retainer 150 may be formed at an outer side of the third rail member flange 134. Thus, the second ball B2 of the second retainer 150 may slide while being in rolling contact with the third rail member 130 along the third rail raceway 138. The third rail raceway 138 may be formed in a longitudinal direction of the third rail member 130 so as to accommodate the second ball B2.

In the present embodiment, the storage bodies 18 and 19 may be fixed to the third rail member 130. However, the third rail member 130 may be omitted, and the second rail member 120 may also be fixed to the storage bodies 18 and 19.

The second retainer 150 may be provided between the second rail member 120 and the third rail member 130 and may support sliding movement of the third rail member 130. The second retainer 150 may include a plurality of second balls B2 and a second retainer body 152 that supports the plurality of second balls B2 rotatably.

The second retainer body 152 may include a second ball groove 153 into which the second ball B2 is rotatably inserted. Thus, the second ball B2 may rotate along the third rail raceway 138 and the inner raceway 129 while being inserted into the second ball groove 153.

Figure 5:
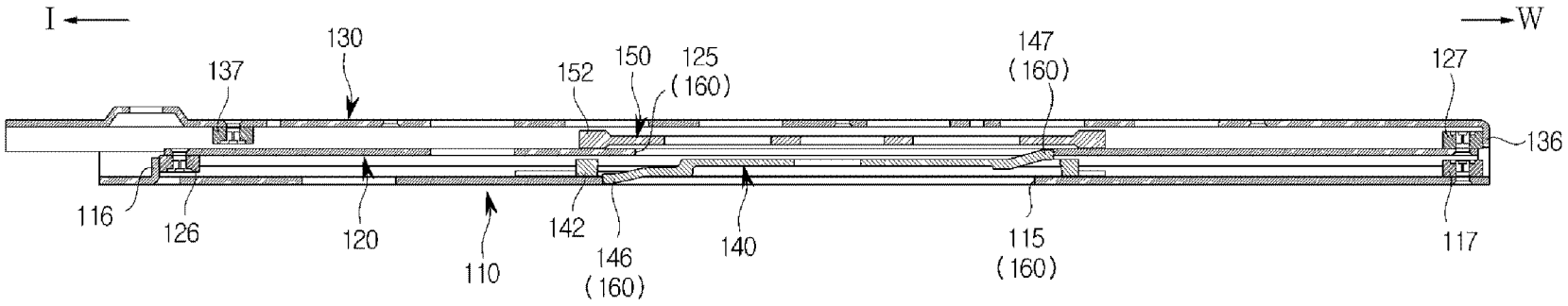
FIG. 5 is a cross-sectional view of the rail device of FIG. 3 inserted into the refrigerator, taken along line A-A' of FIG. 3.
Figure 6:
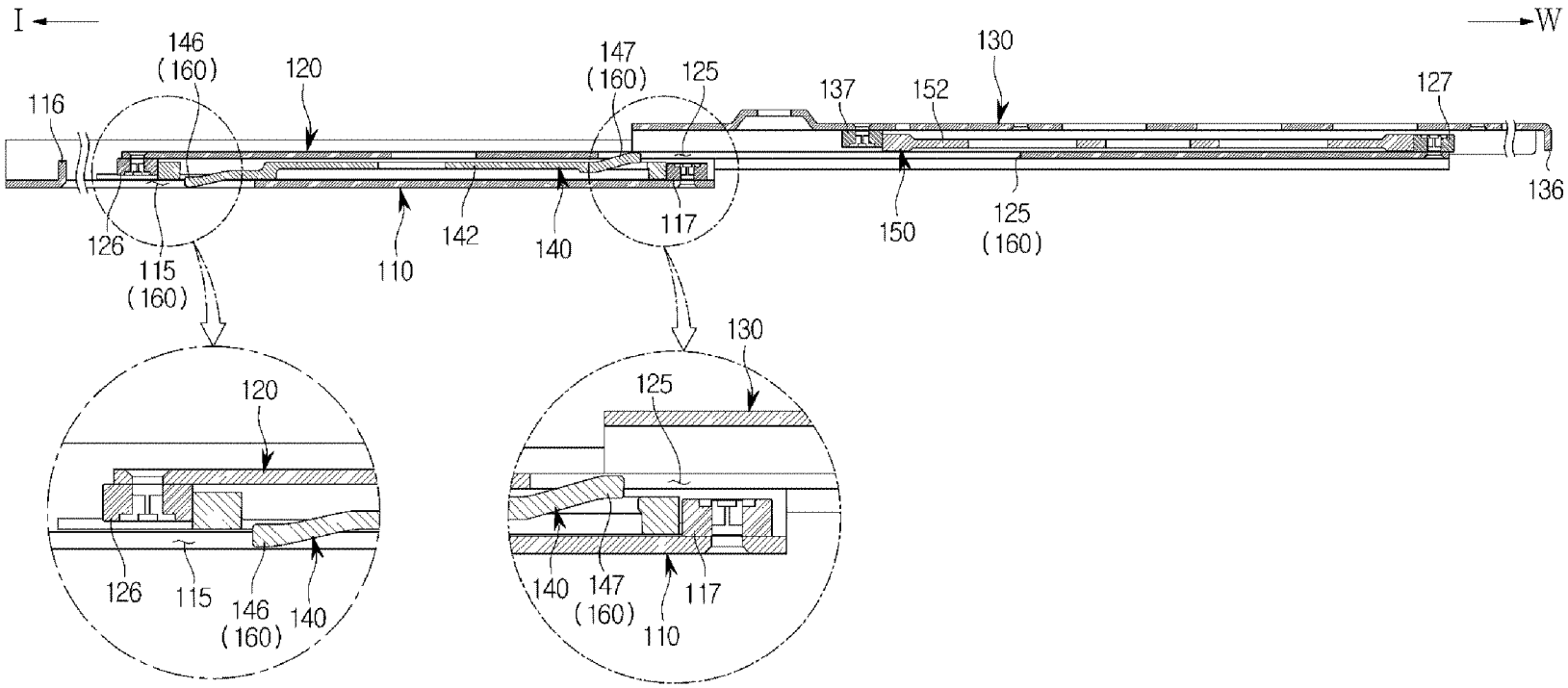
FIG. 6 is a cross-sectional view of the rail device taken along line A-A' of FIG. 3.
Figure 7:
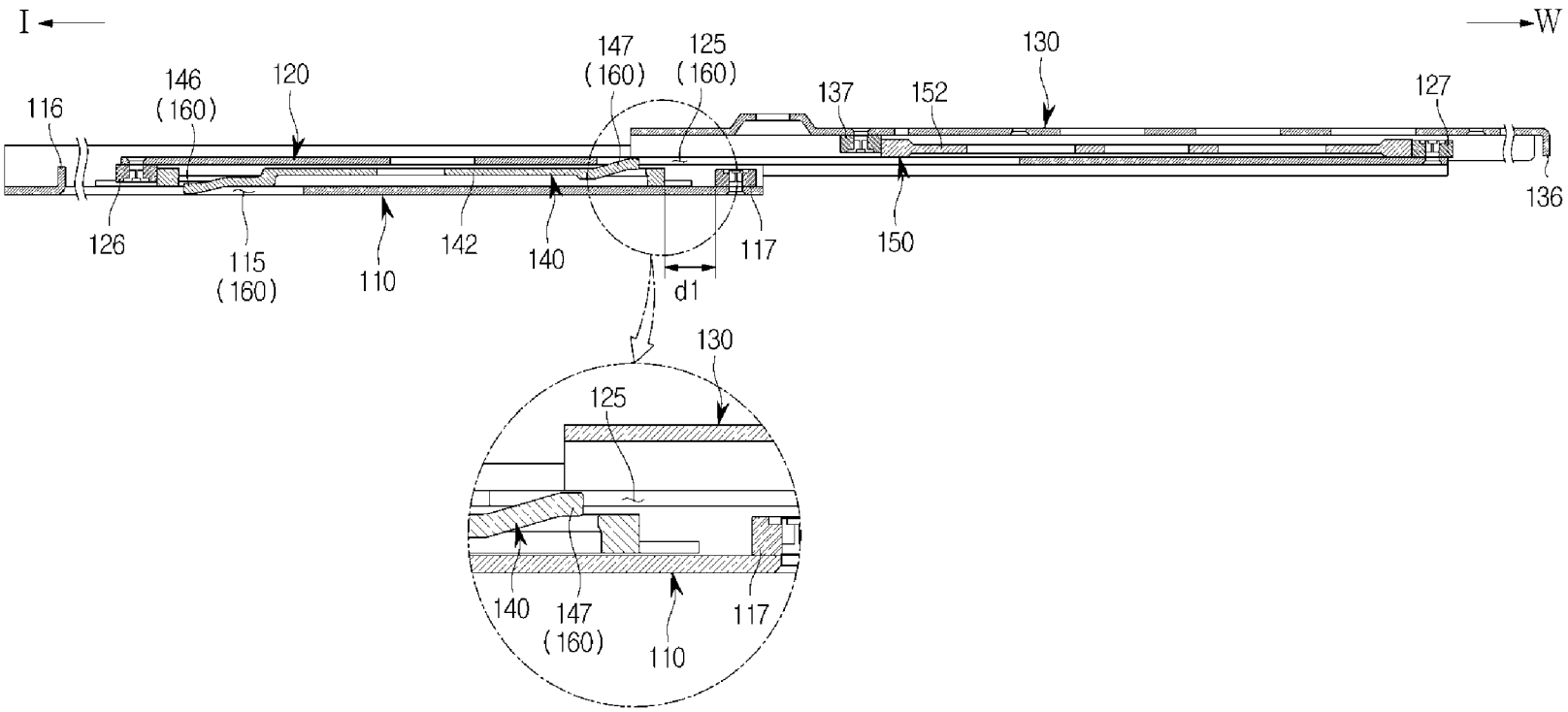
FIG. 7 is a view of a state in which a position of the first retainer is changed in the insertion direction while the rail device of FIG. 5 is withdrawn from the refrigerator.
Figure 8:
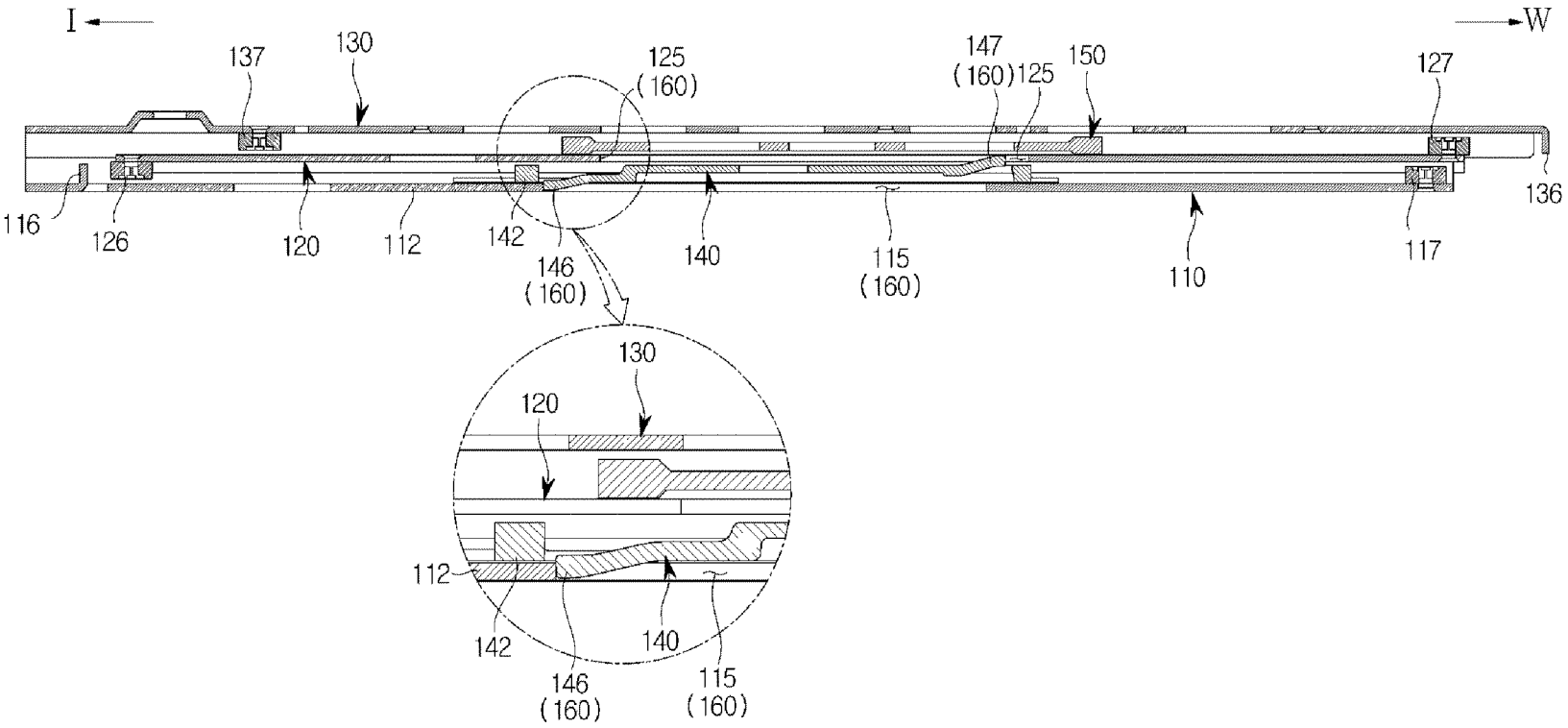
FIG. 8 is a view of a state in which the first retainer is moved to its original position while the rail device of FIG. 7 is inserted into the refrigerator.
Figure 9:
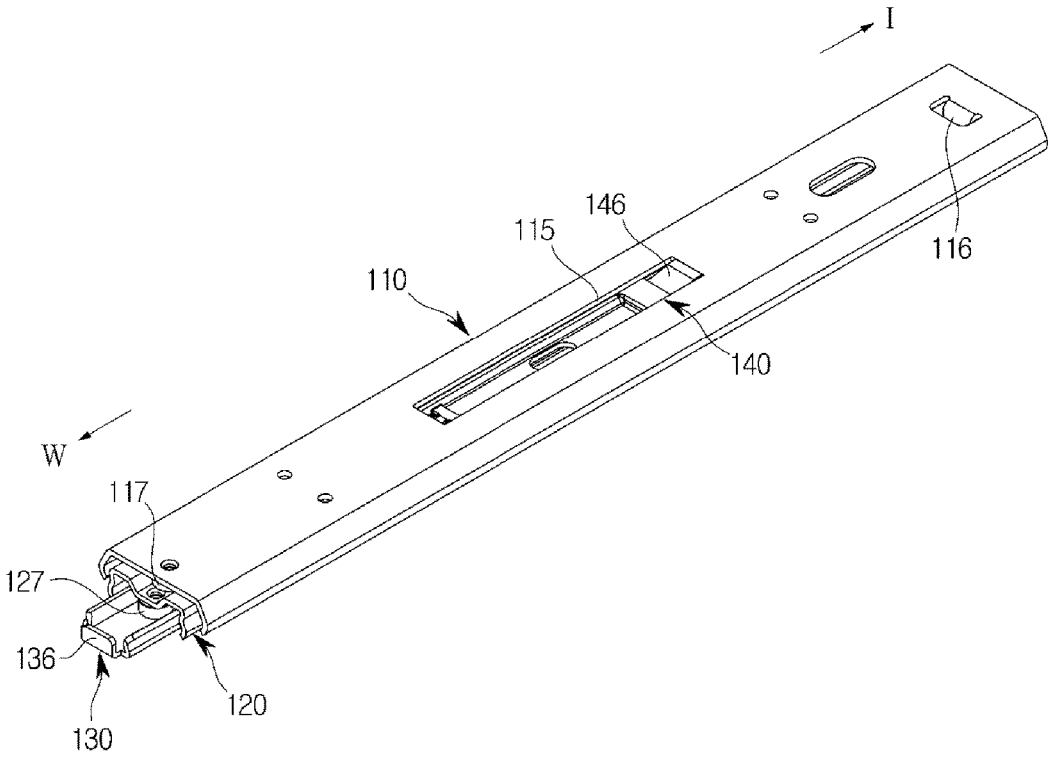
FIG. 9 is a perspective view of the rail device of FIG. 8.
Figure 10:
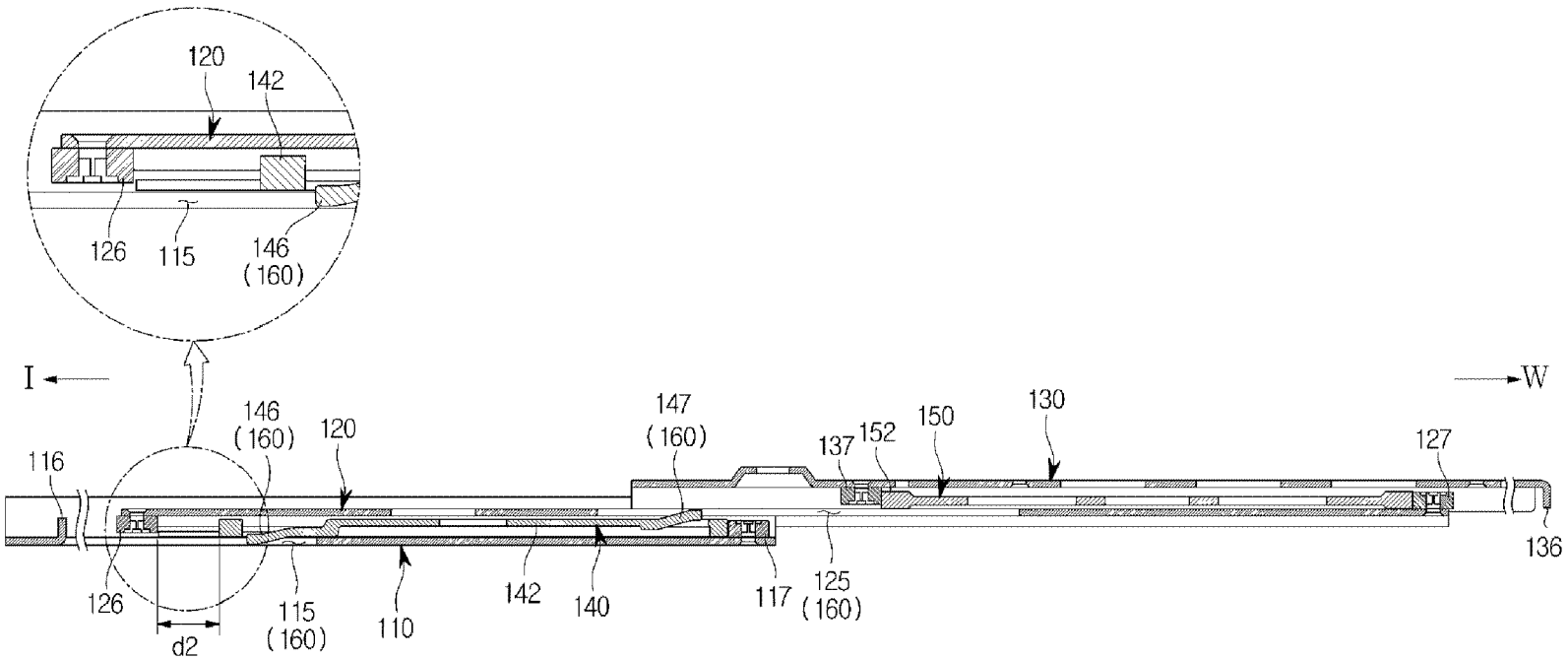
FIG. 10 is a view of a state in which the position of the first retainer is changed in the withdrawal direction while the rail device of FIG. 5 is withdrawn from the refrigerator.
Figure 11:
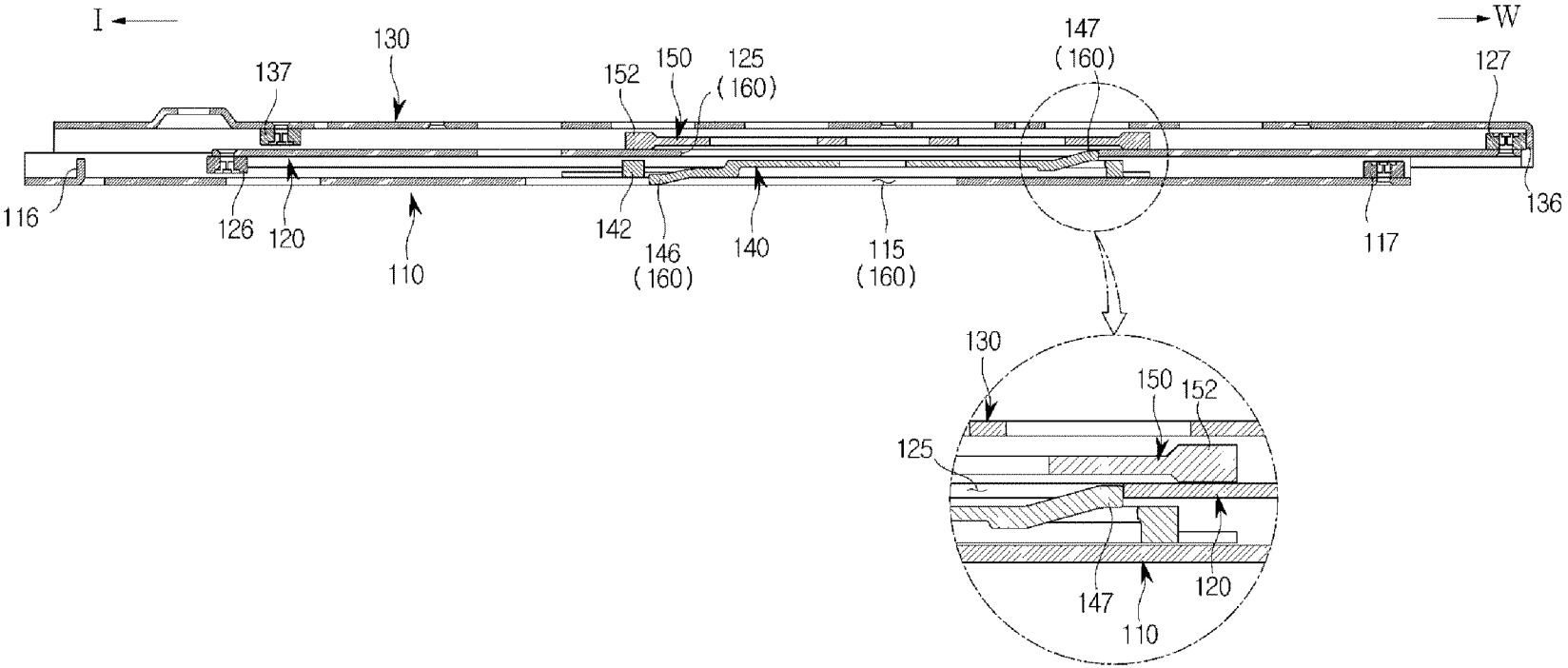
FIG. 11 is a view of a state in which the first retainer is moved to its original position while the rail device of FIG. 10 is withdrawn from the refrigerator.
Figure 12:
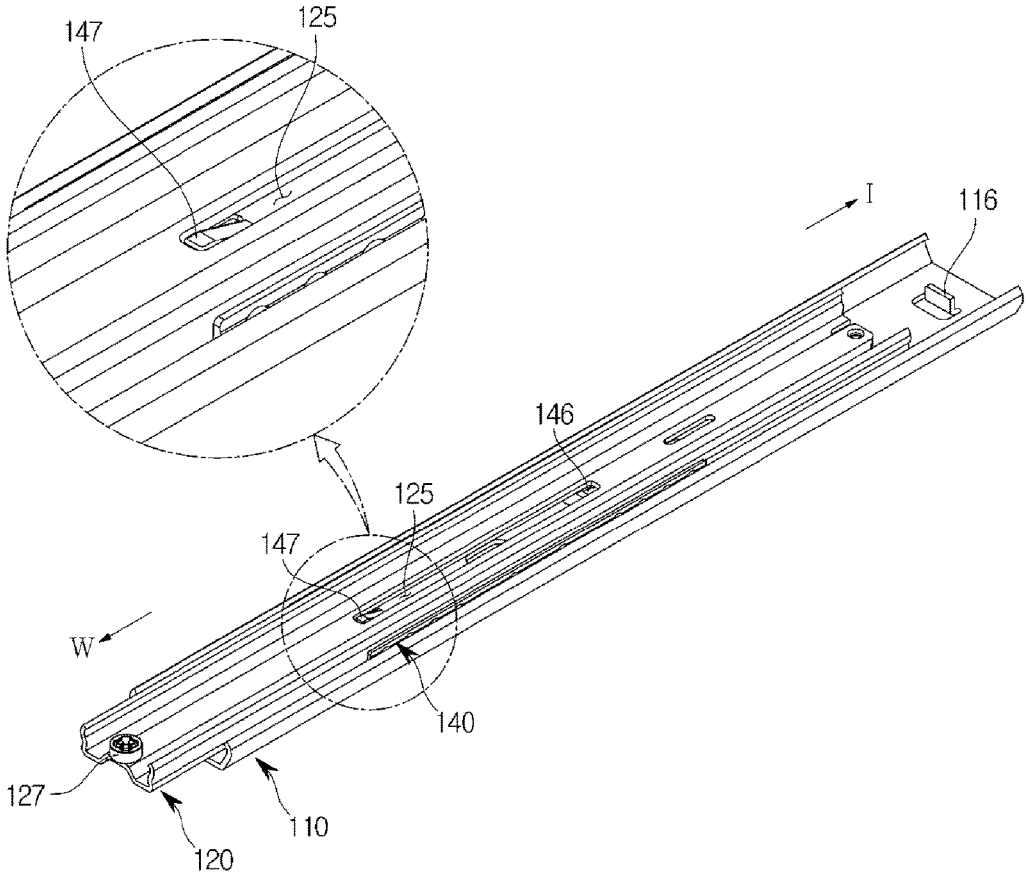
FIG. 12 is a perspective view of the rail device of FIG. 11.

FIG. 5 is a cross-sectional view of the rail device 100 of FIG. 3 inserted into the refrigerator 1, taken along line A-A' of FIG. 3. FIG. 6 is a cross-sectional view of the rail device 100 taken along line A-A' of FIG. 3. FIG. 7 is a view of a state in which a position of the first retainer 140 is changed in the insertion direction while the rail device 100 of FIG. 5 is withdrawn from the refrigerator 1. FIG. 8 is a view of a state in which the first retainer 140 is moved to its original position while the rail device 100 of FIG. 7 is inserted into the refrigerator 1. FIG. 9 is a perspective view of the rail device 100 of FIG. 8. FIG. 10 is a view of a state in which the position of the first retainer 140 is changed in the withdrawal direction while the rail device 100 of FIG. 5 is withdrawn from the refrigerator 1. FIG. 11 is a view of a state in which the first retainer 140 is moved to its original position while the rail device 100 of FIG. 10 is withdrawn from the refrigerator 1. FIG. 12 is a perspective view of the rail device of FIG. 11.

An operation of the rail device 100 will be described with reference to FIGS. 5 to 12.

Referring to FIG. 5, when the storage bodies 18 and 19 are inserted into the storage compartment through the rail device 100, the third support protrusion 126 of the second rail member 120 is supported by the first support protrusion 116 of the first rail member 110, and the fifth support protrusion 136 of the third rail member 130 is supported by the fourth support protrusion 127 of the second rail member 120. In this case, the first guide protrusion 146 of the first retainer 140 is in contact with one side of the insertion direction I of the first guider 115 of the first rail member 110, and the second guide protrusion 147 of the first retainer 140 is in contact with one side of the withdrawal direction W of the second guider 125 of the second rail member 120. Here, a position of the first retainer 140 will be referred to as an insertion position.

Referring to FIG. 6, if there is no change of the position of the first retainer 140 while the storage bodies 18 and 19 are withdrawn from the storage compartment through the rail device 100 of FIG. 5, one end of the withdrawal direction W of the first retainer 140 is supported on the second support protrusion 117 of the first rail member 110, and the third support protrusion 126 of the second rail member 120 is supported at one end of the insertion direction I of the first retainer 140, and one end of the withdrawal direction W of the second retainer 150 is supported on the fourth support protrusion 127 of the second rail member 120, and the sixth support protrusion 137 of the third rail member 130 is supported at one end of the insertion direction I of the second retainer 150. Here, a position of the first retainer 140 will be referred to as a withdrawal position.

On the other hand, referring to FIG. 7, the position of the first retainer 140 may be changed in the insertion direction I by a first distance d1 while the rail device 100 withdraws the storage bodies 18 and 19. The change of the position of the first retainer 140 occurs due to the first retainer 140 that does not move in the withdrawal direction W as the first ball B1 of the first retainer 140 is slipped on the first rail raceway 118 of the first rail member 110 and the outer raceway 128 of the second rail member 120 while being withdrawn from the first retainer 140. Thus, the second rail member 120 of which movement in the withdrawal direction W is limited by the first retainer 140, the second retainer 150, and the third rail member 130 do not move in the withdrawal direction W by the first distance dl. Thus, the storage bodies 18 and 19 are not fully withdrawn from the storage compartment. In this situation, the user does not easily withdraw food inside the storage bodies 18 and 19 and has to apply an excessive withdrawal force to the storage bodies 18 and 19 so as to forcibly withdraw the first retainer 140.

Referring to FIGS. 8 and 9, in order to solve this problem, the rail device 100 may include the position correction guide 160 that guides the first retainer 140 so that the first retainer 140 can be located at the insertion position while the storage bodies 18 and 19 are inserted into the storage compartment.

In detail, when the position of the first retainer 140 is changed in the insertion direction I, as illustrated in FIG. 7, although the storage bodies 18 and 19 are not fully inserted into the storage compartment, the first guide protrusion 146 may be in contact with one side of the insertion direction I of the first guider 115 and may limit movement in the insertion direction I of the first retainer 140. That is, when the storage bodies 18 and 19 are inserted into the storage compartment in a state in which the position of the first retainer 140 is changed in the insertion direction I by the first distance d1, although the first retainer 140 reaches the insertion position, the second rail member 120, the second retainer 150 and the third rail member 130 are not fully inserted into the rail device 100. In this case, the first guide protrusion 146 may be in contact with one side of the insertion direction I of the first guider 115 and may limit movement in the insertion direction I of the first retainer 140 so that the first retainer 140 can be located at the insertion position. While the first retainer 140 is stopped at the insertion position, the second rail member 120, the second retainer 150, and the third rail member 130 may be fully inserted into the rail device 100. Due to this operation, the rail device 100 may reset the position of the first retainer 140 to the insertion position whenever the storage bodies 18 and 19 are inserted into the storage compartment. Thus, the rail device 100 may prevent accumulation of the change of the position of the first retainer 140.

Subsequently, when the user fully inserts the storage bodies 18 and 19 into the storage compartment 20, as illustrated in FIG. 5, the second rail member 120, the second retainer 150, and the third rail member 130 may be fully inserted into the rail device 100 and may be located at its original position.

Also, referring to FIG. 10, while the storage bodies 18 and 19 are inserted into the storage compartment 20, the position of the first retainer 140 of the rail device 100 may be changed in the withdrawal direction W by a second distance d2. The change of the position of the first retainer 140 occurs due to the first retainer 140 that does not move in the insertion direction I as the first ball B1 of the first retainer 140 is slipped on the first rail raceway 118 of the first rail member 110 and the outer raceway 128 of the second rail member 120 while being inserted into the first retainer 140. Thus, the second rail member 120 of which movement in the withdrawal direction W is limited by the first retainer 140, the second retainer 150, and the third rail member 130 do not move in the withdrawal direction W by the second distance d2. Thus, the storage bodies 18 and 19 are not fully withdrawn from the storage compartment. In this situation, the user does not easily withdraw food inside the storage bodies 18 and 19 from the storage compartment and has to apply an excessive force to the storage bodies 18 and 19 so as to forcibly withdraw the second rail member 120, the second retainer 150, and the third rail member 130 from the rail device 100.

Referring to FIGS. 11 and 12, in order to solve this problem, the rail device 100 may include the position correction guide 160 so that, when the storage bodies 18 and 19 are inserted into the storage compartment, the first retainer 140 can be moved in the insertion position.

In detail, when the position of the first retainer 140 is changed in the withdrawal direction W, as illustrated in FIG. 10, the second guide protrusion 147 is in contact with one side of the withdrawal direction W of the second guider 125 and is pressed by the second guider 125 in the insertion direction I. That is, when the storage bodies 18 and 19 are inserted into the storage compartment in a state in which the position of the first retainer 140 is changed in the withdrawal direction W by the second distance d2, although the second rail member 120, the second retainer 150 and the third rail member 130 are fully inserted into the rail device 100, the first retainer 140 does not reach the insertion position. In this case, the second guide protrusion 147 is pressed by one side of the withdrawal direction W of the second guider 125, and the first retainer 140 is moved in the insertion direction I and is guided to the insertion position. Thus, the first retainer 140, the second rail member 120, the second retainer 150, and the third rail member 130 may be fully inserted into the rail device 100, as illustrated in FIG. 5. Due to this operation, the rail device 100 may reset the position of the first retainer 140 to the insertion position whenever the storage bodies 18 and 19 are inserted into the storage compartment. Thus, the rail device 100 may prevent accumulation of the change of the position of the first retainer 140.

Figure 13:
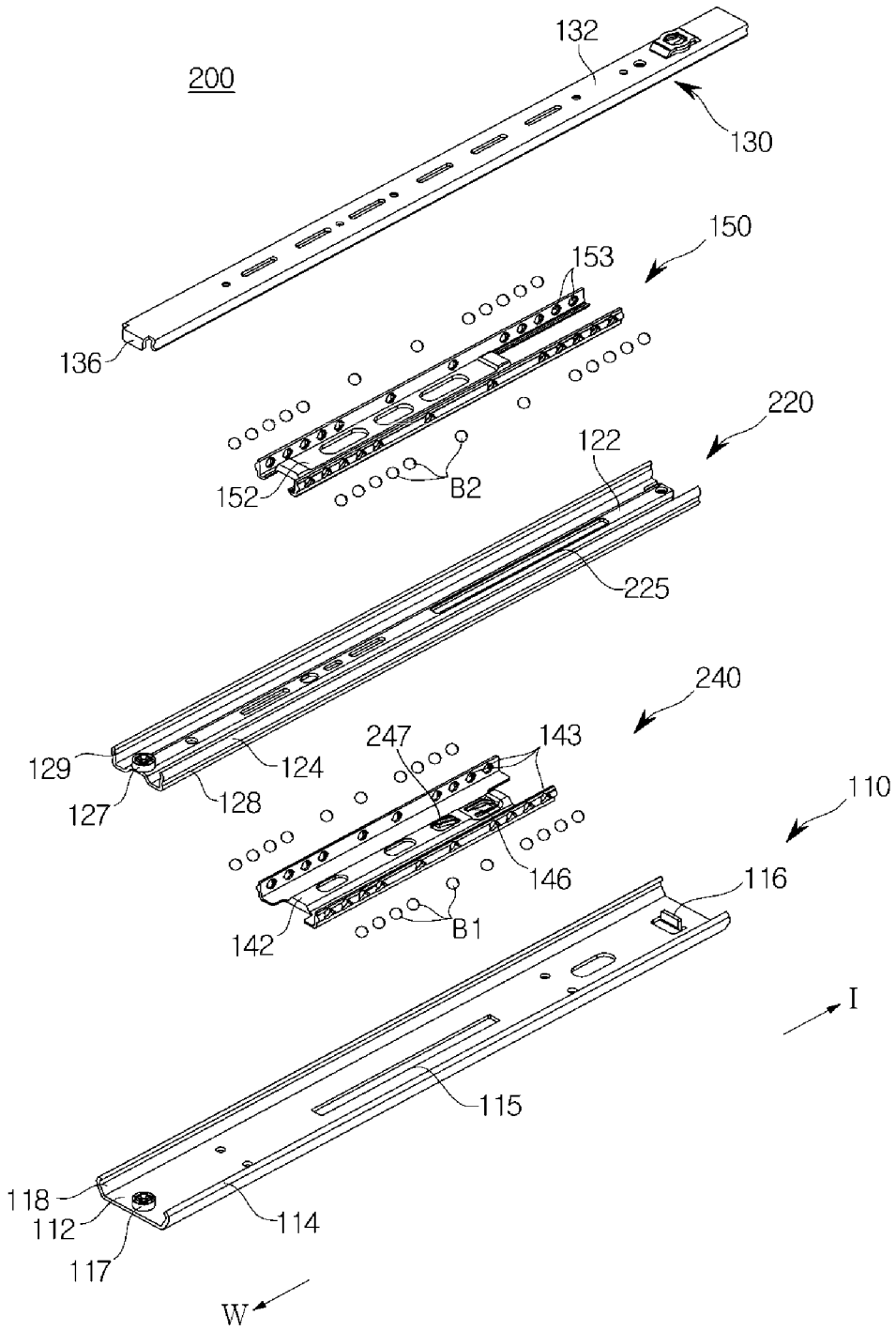
FIG. 13 is an exploded perspective view of a rail device according to another embodiment.
Figure 14:
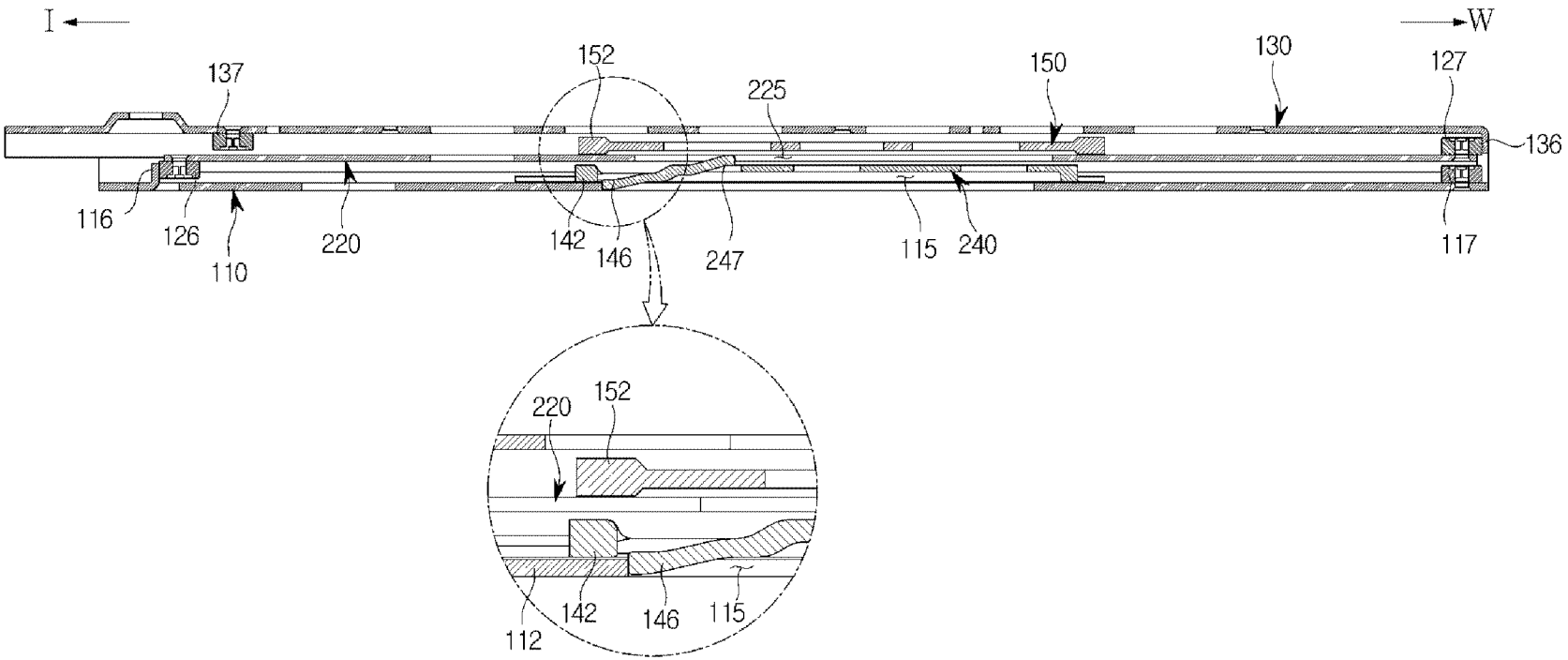
FIG. 14 is a cross-sectional view of the rail device illustrated in FIG. 13.

FIG. 13 is an exploded perspective view of a rail device according to another embodiment. FIG. 14 is a cross-sectional view of the rail device illustrated in FIG. 13.

A rail device 200 according to another embodiment will be described with reference to FIGS. 13 and 14. However, redundant descriptions with the above descriptions will be omitted.

The rail device 200 according to the embodiment of FIGS. 13 and 14 may include a first retainer 240 that is provided between the first rail member 110 and a second rail member 220 and supports sliding movement of the second rail member 220.

The first retainer 240 includes a second guide protrusion 247 formed at one side of the insertion direction I in which the first guide protrusion 146 is formed. The second guide protrusion 247 may be formed by bending a part of the first retainer body 142 having the first guide protrusion 146 therein, toward the second rail member 220. The second guide protrusion 247 may be inclined toward the second rail member 220 as getting closer to the withdrawal direction W from the first retainer body 142 and may have predetermined elasticity.

The second rail member 220 may include a second guider 225 into which the above-described second guide protrusion 247 is inserted and which guides the second guide protrusion 247. The second guider 225 may be formed along a movement path of approximately the second guide protrusion 247. One side of the withdrawal direction W of the second guider 225 may be in contact with the second guide protrusion 247, may press the second guide protrusion 247 and may move the first retainer 240 in the insertion direction I.

Figure 15:
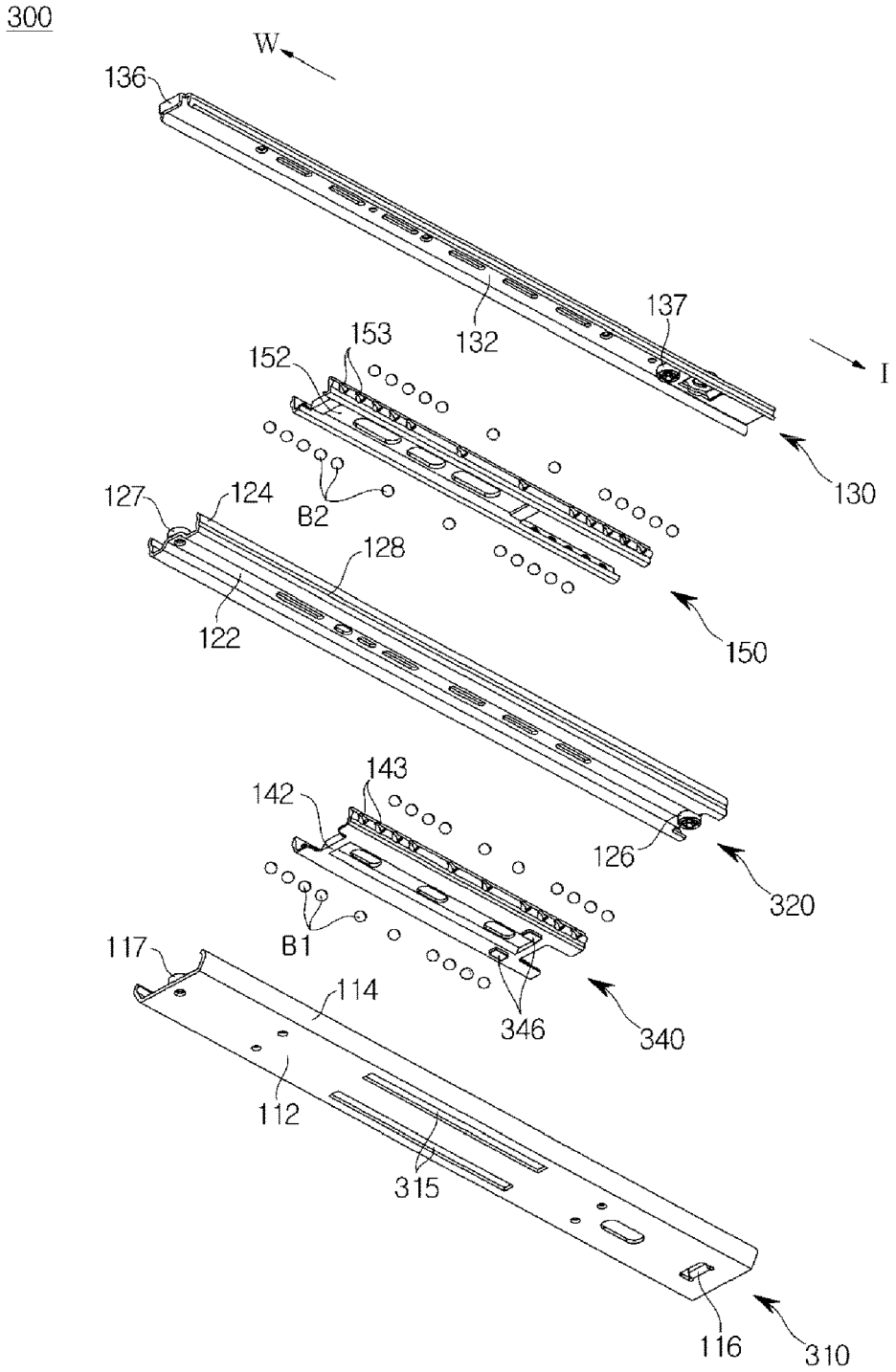
FIG. 15 is an exploded perspective view of a rail device according to still another embodiment.
Figure 16:
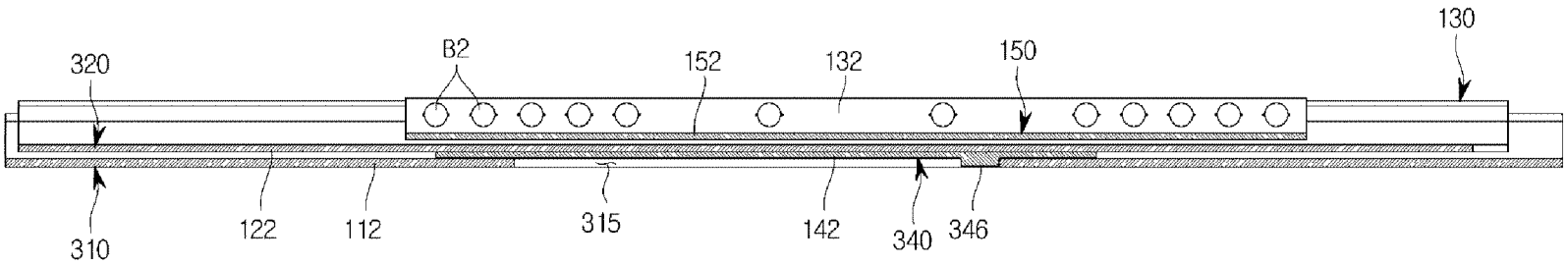
FIG. 16 is a cross-sectional view of the rail device illustrated in FIG. 15.

FIG. 15 is an exploded perspective view of a rail device according to still another embodiment. FIG. 16 is a cross-sectional view of the rail device illustrated in FIG. 15.

A rail device 300 according to still another embodiment will be described with reference to FIGS. 15 and 16. However, redundant descriptions with the above descriptions will be omitted.

The rail device 300 according to the embodiment of FIGS. 15 and 16 may include a first retainer 340 that is provided between a first rail member 310 and a second rail member 320 and supports sliding movement of the second rail member 320.

The first retainer 340 may include a first guide protrusion 346 that protrudes toward the first rail member 310. A plurality of first guide protrusions 346 may be provided. In FIG. 13, two first guide protrusions 346 may be provided. However, embodiments of the present invention are not limited thereto, and three or more first guide protrusions 346 may be provided.

The first rail member 310 may include a first guider 315 into which the first guide protrusions 346 are inserted and which guides the first guide protrusions 346. The number of first guiders 315 corresponding to the number of first guide protrusions 346 may be provided.

Furthermore, the first retainer 340 according to the present embodiment may not include a second guide protrusion, unlike in the embodiment of FIG. 4 and the embodiment of FIG. 13. Thus, the second rail member 320 does not have a second guider.

Figure 17:
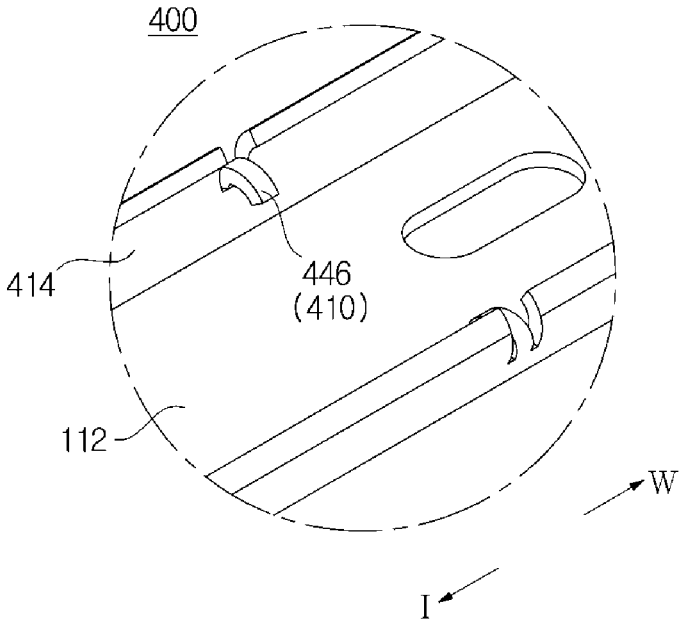
FIG. 17 is a partial perspective view of a first guide protrusion of a first rail member of a rail device according to yet another embodiment.

FIG. 17 is a partial perspective view of a first guide protrusion of a first rail member of a rail device according to yet another embodiment.

A rail device 400 according to yet another embodiment will be described with reference to FIG. 17. However, redundant descriptions with the above descriptions will be omitted.

The rail device 400 according to the embodiment of FIG. 17 may include a first guide protrusion 446 formed on a first rail member 410 so as to limit the range of movement in the insertion direction I of the first retainer 140. The first guide protrusion 446 may be formed by bending a part of a first rail member flange 414 provided at both sides of the first rail member body 112. Thus, because the range of sliding movement in the insertion direction I is limited, the first retainer 140 may be located at the insertion position while the storage bodies 18 and 19 are inserted into the storage compartment.

As described above, in the refrigerator 1 according to the present invention, the first retainers 140, 240, and 340 of the rail devices 100, 200, 300, and 400 are guided to be located at the insertion position while the storage bodies 18 and 19 are inserted into the storage compartment so that, when the storage bodies 18 and 19 are withdrawn from the storage compartment, the position of the first retainer 140, 240, or 340 is changed and thus a problem that the user has to withdraw the storage bodies 18 and 19 from the storage compartment by applying an excessive force thereto can be prevented.

According to the spirit of the invention, when a retainer escapes from its original position due to slippage of a ball, a rail device can correct the position of the retainer into its original position while rail members are inserted into the retainer.

According to the spirit of the invention, because the rail device corrects the position of the retainer into its original position, the use of an excessive force required to withdraw a storage body can be prevented.

According to the spirit of the invention, a refrigerator can withdraw the storage body fully from a storage compartment as the position of the retainer is corrected into its original position. Thus, a user can withdraw a storage article inside the storage body easily.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body having a storage compartment therein;

a storage body provided to be inserted into or withdrawn from the storage compartment; and a rail device configured to connect the body and the storage body slidingly and to guide insertion and withdrawal of the storage body, wherein the rail device comprises:

a first rail member having a first guider therein;

a second rail member slidingly coupled to the first rail member; and a first retainer disposed at an insertion position between the first rail member and the second rail member when the first rail member is inserted into the first retainer and having a first guide protrusion inserted into the first guider movably, formed in the first retainer, and the first guider limits a range of movement in an insertion direction of the first retainer when the first retainer is inserted into the first guider so that the first retainer is located at the insertion position.

2. The refrigerator according to claim 1, wherein the first retainer includes a second guide protrusion that protrudes to the second rail member, and the second rail member includes a second guider that guides the second guide protrusion.

3. The refrigerator according to claim 2, wherein the second guider presses the second guide protrusion in an insertion direction when the first retainer is inserted into the second guider so that the first retainer is located at the insertion position.

4. The refrigerator according to claim 2, wherein the first guide protrusion is formed at one side of the first retainer, and the second guide protrusion is formed at the other side opposite to the one side of the first retainer at which the first guide protrusion is formed.

5. The refrigerator according to claim 2, wherein the first guide protrusion and the second guide protrusion are formed at one side of the first retainer.

6. The refrigerator according to claim 1, wherein the first rail member includes a first support protrusion that supports the second rail member so that, when the second rail member is inserted into the first rail member, the second rail member does not escape from the first rail member.

7. The refrigerator according to claim 1, wherein the first rail member includes a second support protrusion that supports the first retainer so that, when the first retainer is withdrawn from the first rail member, the first retainer does not escape from the first rail member, and the second rail member includes a third support protrusion supported by the first retainer so that, when the second rail member is withdrawn from the first rail member, the second rail member does not escape from the first rail member.

8. The refrigerator according to claim 2, wherein at least one of the first guide protrusion and the second guide protrusion has elasticity.

9. The refrigerator according to claim 1, further comprising:

a third rail member slidingly coupled to the second rail member; and a second retainer that supports sliding movement of the third rail member.

10. The refrigerator according to claim 1, wherein a plurality of first guiders and a plurality of first guide protrusions are provided.

11. A refrigerator comprising:

a body having a storage compartment therein;

a storage body provided to be inserted into or withdrawn from the storage compartment; and a rail device configured to connect the body and the storage body slidingly and to guide insertion and withdrawal of the storage body, wherein the rail device comprises:

a first rail member fixed to the body and having a first guider therein;

a second rail member slidingly coupled to the first rail member and having a second guider therein; and a first retainer supporting sliding movement of the second rail member and having a first guide protrusion guided by the first guider and a second guide protrusion guided by the second guider.

12. The refrigerator according to claim 11, wherein, when the storage body is inserted into the body, the first retainer is located at an insertion position by means of the first guider or the second guider.

13. The refrigerator according to claim 11, wherein the rail device further includes:

a third rail member fixed to the storage body and slidingly coupled to the second rail member; and a second retainer supporting sliding movement of the third rail member.

14. The refrigerator according to claim 11, wherein the second guide protrusion protrudes in an opposite direction to a direction in which the first guide protrusion protrudes.

15. The refrigerator according to claim 11, wherein the first rail member includes a first support protrusion that supports the second rail member so that, when the second rail member is inserted into the first rail member, the second rail member does not escape from the first rail member.

16. A rail device comprising:

a first rail member;

a second rail member slidingly coupled to the first rail member;

a first retainer supporting sliding movement of the second rail member and disposed at an insertion position when the second rail member is inserted into the first rail member; and a position correction guide that guides the first retainer so that, when the second rail member is inserted into the first rail member, the first retainer is located at the insertion position, wherein the position correction guide includes:

a first guider formed on the first rail member, and a first guide protrusion formed on the first retainer and guided by the first guider.

17. The rail device according to claim 16, wherein the position correction guide includes:

a second guider formed on the second rail member; and a second guide protrusion formed on the first retainer and guided by the second guider.

18. The rail device according to claim 17, wherein, when the first retainer is inserted into the first rail member, the first guide protrusion is in contact with one end of an insertion direction of the first guider, and the second guide protrusion is in contact with one end of a withdrawal direction of the second guider.

19. The rail device according to claim 16, wherein the position correction guide includes a limiting protrusion that protrudes on a sliding movement path of the second rail member formed on the first rail member.

* * * * *